US005604395A

United States Patent [19]

Nishimura et al.

[11] Patent Number: 5,604,395

[45] Date of Patent: Feb. 18, 1997

[54] COLOR CATHODE-RAY TUBE HAVING SUBSTANTIALLY FLAT FACE AND REAR PLATES OPPOSING EACH OTHER

[75] Inventors: Takashi Nishimura; Kazuyuki Seino, both of Fukaya; Tohru Takahashi, Kumagaya; Yuuji Haraguchi, Fukaya, all of Japan

[73] Assignee: Kabushiki Kaisha Toshiba, Kawasaki, Japan

[21] Appl. No.: 273,871

[22] Filed: Jul. 12, 1994

[30] Foreign Application Priority Data

Jul. 13, 1993 [JP] Japan ..... 5-172899
Jun. 13, 1994 [JP] Japan ..... 6-129384

[51] Int. Cl.[6] ..... H01J 29/02; H01J 31/20

[52] U.S. Cl. ..... 313/482; 313/402

[58] Field of Search ..... 313/477 R, 482, 313/2.1, 402

[56] References Cited

U.S. PATENT DOCUMENTS 3,071,706 1/1963 Waldorf .
4,900,981 2/1990 Yamazaki et al. ..... 313/477 R

FOREIGN PATENT DOCUMENTS 0548467 6/1993 European Pat. Off. .
48-90428 11/1973 Japan .
2158544 6/1990 Japan .
5036363 2/1993 Japan .
5242826 9/1993 Japan .

*Primary Examiner*—Sandra L. O'Shea
*Assistant Examiner*—Matthew J. Esserman
*Attorney, Agent, or Firm*—Cushman Darby & Cushman, IP Group of Pillsbury Madison & Sutro LLP

[57] ABSTRACT

A color cathode-ray tube with a vacuum envelope that includes a rectangular, flat face plate and a rectangular, flat rear plate opposing the face plate. A phosphor screen is formed on an inner surface of the face plate, and fixing members are fixed to an inner surface of the rear plate. A shadow mask arranged in the envelope is supported by mask support members to face the phosphor screen at a predetermined distance. Plate support members are arranged in the envelope to support a load of atmospheric pressure acting on the face plate and the rear plate. The mask support members and the plate support members are fixed to the fixing members while being in close contact with the inner surface of the rear plate.

21 Claims, 4 Drawing Sheets

COLOR CATHODE-RAY TUBE HAVING SUBSTANTIALLY FLAT FACE AND REAR PLATES OPPOSING EACH OTHER

BACKGROUND OF THE INVENTION

1. Field of the Invention

The present invention relates to a cathode-ray tube such as a color picture tube and, more particularly, to a cathode-ray tube having a flat face plate, a flat shadow mask opposing a phosphor screen formed on the inner surface of the face plate, a mask support member supporting the shadow mask, and a plate support member supporting the face plate and a rear plate, wherein the phosphor screen has a plurality of regions which are scanned independently of one another.

2. Description of the Related Art

Recently, various studies have been conducted on high-definition broadcasting and a high-resolution picture tube with a large screen designed for the high-definition broadcasting. In general, in order to achieve high resolution of a picture tube, the spot diameter of an electron beam on a phosphor screen must be reduced.

For this purpose, in the prior art, the structure of an electron gun electrode has been improved, or the caliber and/or length of the electron gun has been increased. However, satisfactory achievement has not been obtained. The main reason is that the distance between the electron gun and the phosphor screen increases in accordance with the increase in size of the picture tube, and the magnification of the electron lens increases excessively. Accordingly, in order to achieve high resolution, it is important to shorten the distance (depth) between the electron gun and the phosphor screen. In addition, when the deflection angle of an electron gun is increased, the difference in magnification between the center area and peripheral area of the phosphor screen increases. Thus, wide-angle deflection is not advantageous for achieving high resolution.

Under the circumstances, in the prior art, as disclosed as in Jpn. Pat. Appln. KOKAI Publication No. 48-90428, there is known a method of arranging a plurality of independent small-sized picture tubes, thereby constituting a high-resolution, large screen. This kind of method is effective for large-scale screen display with a large number of divided regions, which is designed for outdoor installation. However, when this method is applied to middle-scale screen display (e.g., the screen size is about 40 inches), connection portions between the divided regions of the screen are conspicuous, resulting in low-quality images. Thus, when the display formed by this method is used as a household TV receiver or computer-aided design (CAD), the connection portions on the screen are a serious defect.

On the other hand, U.S. Pat. No. 3,071,706 discloses a picture tube wherein a plurality of independent picture tubes are continuously arranged and the screens of these picture tubes are integrated. According to this picture tube having the integrated phosphor screen, a vacuum envelope is constituted by a face plate having an inner surface coated with a phosphor screen, a rear plate opposed to the face plate, funnels adjacent to the rear plate, and necks provided on the funnels.

In the case of this structure of the envelope, however, if the screen surface becomes broader, it is necessary to increase the thickness of the face plate or rear plate in order to withstand the load of atmospheric pressure (external pressure). In addition, it is necessary to provide the face plate with a high curvature in the tube axis direction. As a result, the weight of the envelope becomes considerably heavy, and moreover the screen of the picture tube with the face plate having such a high curvature in the tube axis direction cannot be viewed clearly. In addition, the distance between the phosphor screen and the electron gun sealed within the neck increases, and the magnification of the electron lens is adversely affected.

In order to solve the problems posed in the picture tube having the above integrated phosphor screen, Jpn. Pat. Appln. KOKAI Publication No. 5-36363 discloses a picture tube in which both a face plate and a rear plate are formed to be flat, and an integrated phosphor screen formed on the inner surface of the face plate is dividedly scanned by electron beams emitted from a plurality of electron guns. In this picture tube, plate support members are arranged inside a vacuum envelope to support the load of atmospheric pressure applied to the flat face plate and the flat rear plate.

When, however, the above structure is applied to a color picture tube having a shadow mask, the shadow mask, which is arranged to oppose the phosphor screen, must also be formed to be flat. For this reason, the following problems are posed.

First, there is a problem in the method of attaching the shadow mask. Specifically, in the case of a conventional color picture tube having a spherical face plate, the shadow mask is also spherical. In this case, by fixing a peripheral portion of the shadow mask to a metallic frame (mask frame), practical mechanical strength can be given to the shadow mask and it becomes easy to situate the shadow mask in a predetermined positional relationship with the phosphor screen formed on the inner surface of the face plate. However, in the case of a flat face plate, the shadow mask must also be flattened, and therefore the mechanical strength of the shadow mask is low. Accordingly, this shadow mask cannot easily be situated in a predetermined positional relationship with the phosphor screen only by fixing a frame to the peripheral portion of the shadow mask to reinforce the mask, as in the prior art.

In general, regarding a flat shadow mask or a cylindrical shadow mask which has a curvature only in one direction, sufficient mechanical strength is given to the shadow mask by fixing it to a robust frame with a tensile force applied to the shadow mask, and the shadow mask can be situated in a predetermined positional relationship with the face plate via the frame. A color picture tube having such a structure is disclosed in, e.g., Jpn. Pat. Appln. KOKAI Publication No. 2-158544, in which one large funnel is connected to the face plate.

In this structure, however, with an increase in screen size, the tensile force applied to the shadow mask must be increased accordingly. Consequently, a more robust frame is required. In this case, not only the weight of the entire picture tube increases, but also the attaching means for attaching the shadow mask to the face plate via the frame must have a complicated structure. Furthermore, a sufficient space for providing the attaching means is required.

Second, there is a problem in mounting precision of the shadow mask. A phosphor screen of a regular color picture tube is formed by exposing a phosphor screen material layer such as a phosphor slurry coated on the inner surface of a face plate by a photo-engraving method using a shadow mask incorporated in the color picture tube as a photomask. If, therefore, the distance (q-value) between the shadow mask and the inner surface of the face plate is deviated from a predetermined value, the arrangement pitch of phosphor layers is affected but the continuity of the entire phosphor screen is not affected.

On the other hand, in the case of a color picture tube wherein an integrated phosphor screen has a plurality of regions which are scanned independently of one another, a plurality of effective portions in which a large number of electron beam passage apertures are formed are discontinuously arranged via ineffective portions having no electron beam passage apertures in correspondence with a plurality of regions of the phosphor screen. For this reason, in a color picture tube of this type, the influence of the q-value appears between adjacent regions of the phosphor screen. More specifically, when the q-value is greater than a predetermined value, phosphor layers on adjacent regions of the phosphor screen overlap one another; when the q-value is less than a predetermined value, a gap is produced between phosphor layers on adjacent regions.

In addition, when a phosphor screen is formed by a so-called master mask method using a photomask or a dry plate, the q-value must be accurately set. According to the master mask method, a phosphor screen having continuity can be accurately formed. If, however, the q-value is not exact, an electron beam does not land on a predetermined phosphor layer, i.e., so-called miss-landing occurs, when a color picture tube is assembled. In addition, rasters between adjacent regions overlap one another, or a gap is produced between the rasters.

Furthermore, disregarding the formation of the phosphor screen, the required precision of the q-value is about 0.05 mm, though it depends on the horizontal deflection angle or the arrangement pitch of electron beam passage apertures of the shadow mask. As can be seen from the fact that the required manufacturing precision of the conventional color picture tube is about 0.5 mm, very high precision is required of the q-value. For this reason, in a color picture tube in which one integrated phosphor screen formed on the inner surface of a flat face plate has a plurality of regions which are scanned independently of one another, it is substantially impossible to mount a shadow mask by the conventionally known means.

Third, there is a problem in deformation and vibration in a shadow mask. A flat shadow mask is susceptible to deformation and vibration. When the shadow mask is deformed, the q-value varies, thus causing miss-landing. In addition, when the shadow mask is vibrated, miss-landing also occurs because the q-value changes with time.

As a plate support member arranged in a vacuum envelope to support the load of atmospheric pressure applied to a flat face plate and a flat rear plate, a plate support member having a needle- or wedge-shaped distal end portion in contact with the face plate or a plate support member having a plate-like shape as a whole is available. It is desirable that each of these plate support members be situated outside the locus of electron beams scanning the phosphor screen, and be reduced in size as much as possible. When the distal end portion of each plate support member is formed to be narrow, and the number of plate support members arranged is reduced, the load of atmospheric pressure applied to each support member increases. In addition, when a plurality of plate support members have different heights, the deformation of the face plate is increased by the load of atmospheric pressure, resulting in a deterioration in reliability with respect the resistance to atmospheric pressure.

As described above, in a color picture tube in which one integrated phosphor screen formed on the inner surface of a flat face plate has a plurality of regions which are scanned independently of one another, since a shadow mask arranged to oppose the phosphor screen must also be formed to be flat, problems are posed in terms of a method of attaching the shadow mask, mounting precision of the shadow mask, deformation of the shadow mask, and the like. Especially in a large-sized color picture tube, it is very difficult to arrange a shadow mask with high precision. In addition, it is difficult to realize a simple, lightweight means for mounting the shadow mask. Furthermore, a flat shadow mask is extremely susceptible to deformation and vibration.

SUMMARY OF THE INVENTION

The present invention has been made to solve the above problems, and has an object to provide a cathode-ray tube wherein a flat shadow mask is arranged at a predetermined position with respect to a phosphor screen with high precision and wherein the mask support means can be simple and light in weight, and which is highly resistant to deformation and vibration.

In order to achieve the above object, according to the present invention, there is provided a color cathode-ray tube comprising: a vacuum envelope having a substantially flat face plate and a substantially flat rear plate opposing the face plate to be substantially in parallel thereto; a phosphor screen formed on an inner surface of the face plate; a fixing member fixed to an inner surface of the rear plate; a shadow mask arranged in the envelope; mask support means for supporting the shadow mask to face the phosphor screen at a predetermined distance; and plate support means for bearing a load of atmospheric pressure acting on the face plate and the rear plate. The mask support means and the plate support means are fixed to the fixing member while being in contact with the inner surface of the rear plate.

As described above, according to the present invention, the mask support means and the plate support means are fixed to the fixing member while being in contact with the inner surface of the rear plate. For this reason, both the mask support means and the plate support means can be fixed to the rear plate with high precision without being affected by a bonding material such as frit glass used to fix the fixing member to the rear plate. Therefore, the distance (q-value) between the phosphor screen and the shadow mask is determined by the height of the mask support means itself, and the q-value can be set with high precision. Similarly, the height of the plate support means for supporting the face plate and the rear plate is determined by the processing precision of the plate support means itself, and hence the unbalance of the load of atmospheric pressure acting on the face plate can be reduced by making the height of plate support means constant.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 7 show a color cathode-ray tube according to an embodiment of the present invention, in which:

FIG. 1 is a perspective view showing the structure of the color cathode-ray tube, FIG. 2 is a sectional view taken along a line II—II in FIG. 1, FIG. 3 is an exploded perspective view showing the assembly structure of the color cathode-ray tube, FIG. 4 is a perspective view showing a fixing member, a mask support member, and a plate support member, FIG. 5 is a sectional view taken along a line V—V in FIG. 4, FIG. 6 is a sectional-view showing the mount structure of the plate support member, and FIG. 7 is an enlarged sectional view showing a phosphor screen and a plate support member distal end;

DETAILED DESCRIPTION OF THE PREFERRED EMBODIMENTS

An embodiment of the present invention will be described in detail with reference to the accompanying drawings.

Figure 1:
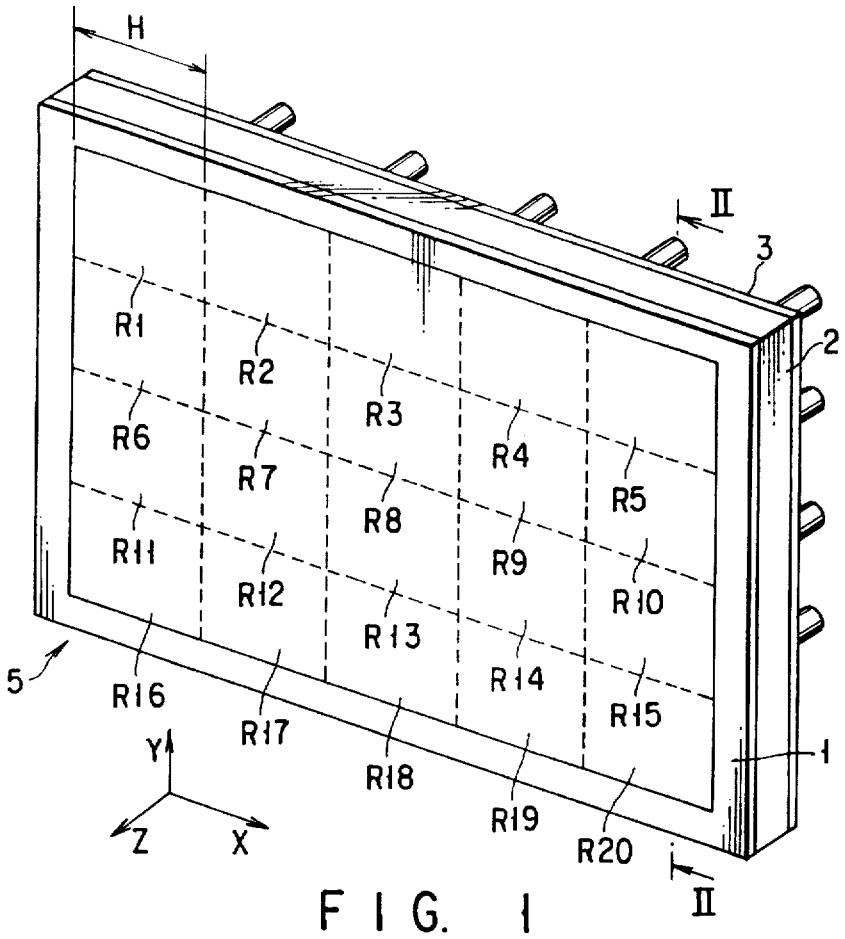
Figure 2:
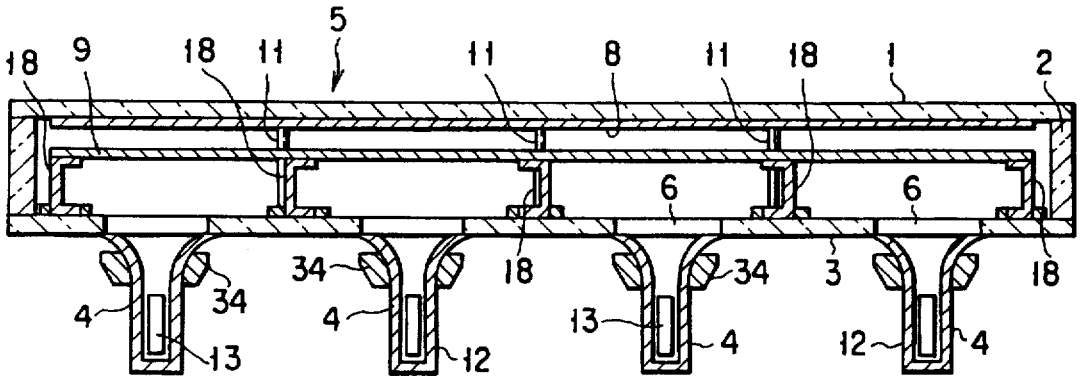
Figure 3:
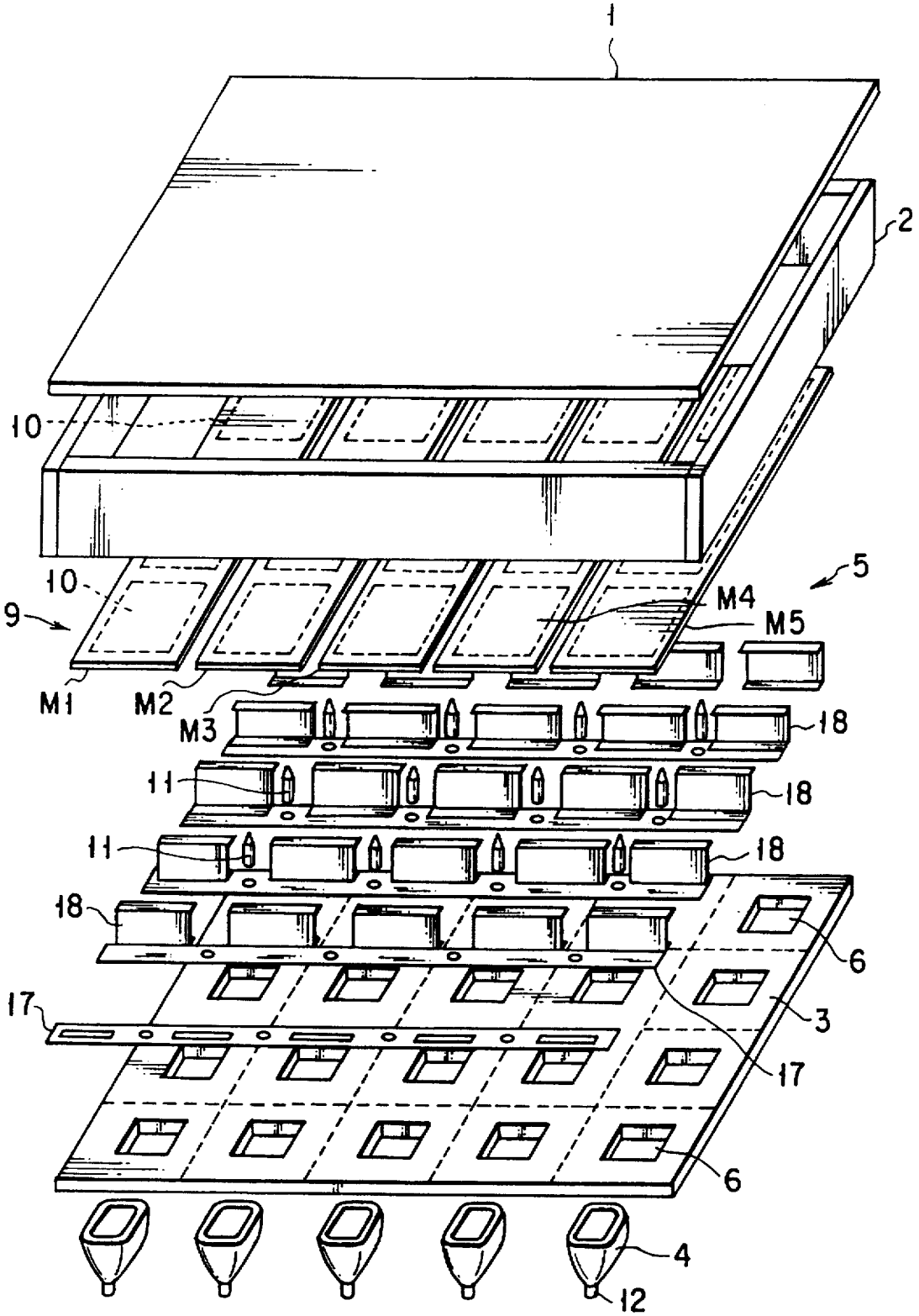

FIGS. 1 to 3 show a color cathode-ray tube according to an embodiment of the present invention. This color cathode-ray tube has a vacuum envelope 5 which includes a substantially rectangular, flat face plate 1, a frame-like side wall 2, a substantially rectangular, flat rear plate 3, and a plurality of funnels 4. The side wall 2 is joined to the face plate 1 along the edge portion of the face plate 1 with a bonding material such as frit glass and extends in a direction substantially perpendicular to the face plate 1. The rear plate 3 is joined to the side wall 2 with frit glass to be opposite and parallel to the face plate 1. The funnels 4 are fixed to the rear plate 3 with frit glass. The rear plate 3 is provided with a plurality of (e.g., 20) rectangular openings 6 which are arranged in the form of a matrix, e.g., five (columns)×four (rows). The funnels 4 are joined to the outer surface of the rear plate 3 to surround the corresponding openings 6, respectively. A total of 20 funnels 4 are arranged in the form of a matrix of five funnels in the horizontal direction (X direction)×four funnels in the vertical direction (Y direction).

Figure 7:
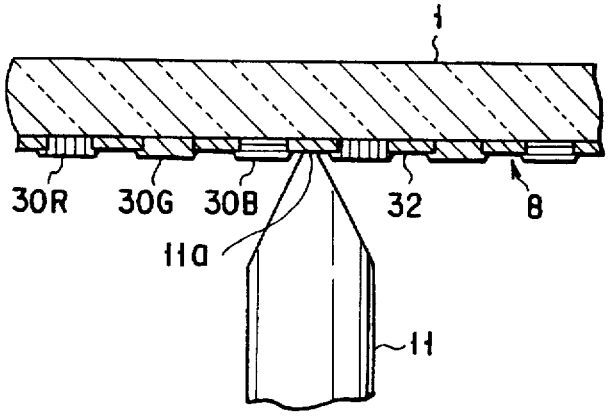

As shown in FIG. 7, an integrated phosphor screen 8 is formed on the inner surface of the face plate 1. The phosphor screen 8 has stripe-shaped three-color phosphor layers 30B, 30G, and 30R which emit blue, green, and red light, and black stripes 32 provided between the three-color phosphor layers. All stripes extend in the vertical direction.

A flat shadow mask 9 is arranged in the envelope 5 to oppose the phosphor screen 8. The shadow mask 9 has a plurality of effective portions 10 corresponding to a plurality of regions R1 to R20 of the phosphor screen 8 which are scanned independently of one another, as will be described later. A large number of apertures (electron beam passage apertures) for passing electron beams are formed in each effective portion. The shadow mask 9 is divided into regions in the horizontal direction in correspondence with the number of divided regions of the phosphor screen 8 in the horizontal direction. That is, in the case shown FIGS. 1 to 3, the shadow mask 9 is divided into five elongated, flat division masks M1 to M5, which are arranged in parallel at predetermined intervals in the horizontal direction. Each division mask extends in the vertical direction and has four effective portions 10 which are continuous with each other via ineffective portions.

The shadow mask 9 is supported on the rear plate 3 by means of a plurality of mask support members (to be described later). An electron gun 13 (beam emitting means) for emitting an electron beam is arranged within a neck 12 of each funnel 4. A plurality of plate support members 11 made of metallic columnar members are arranged between the face plate 1 and the rear plate 3 to support the load of atmospheric pressure acting on the face plate 1 and the rear plate 3 of the vacuum envelope 5. As shown in FIG. 7, a distal end portion 11*a* of each plate support member 11 has a wedge-like shape and is in contact with a corresponding black stripe 32 of the phosphor screen 8.

In this color cathode-ray tube, an electron beam emitted from each electron gun 13 is deflected horizontally and vertically by using a magnetic field generated by a deflection yoke 34 mounted on the outer surface of the funnel 4. With this operation, a plurality of regions R1 to R20 (five regions in each row; four regions in each column; a total of 20) of the phosphor screen 8 is dividedly scanned by electron beams via the effective portions 10 of the division masks M1 to M5. Rasters formed on the phosphor screen 8 by this divisional scan are connected with each other by signals applied to the electron guns 13 and the deflection yokes 34. As a result, a single large raster free from discontinuity is reproduced on the entire phosphor screen 8.

If the shadow mask 9 is divided into the division masks M1 to M5 in the horizontal direction in the above manner, no heat generated in each mask upon collision of an electron beam is transferred to the adjacent masks. Therefore, a purity drift due to thermal expansion of the shadow mask in the conventional color cathode-ray tube can be prevented. Although the respective division masks are connected to each other in the vertical direction, formed images are not affected by the thermal expansion of the shadow mask because the three-color phosphor layers of the phosphor screen 8 are formed into stripes elongated in the vertical direction.

Especially in this color cathode-ray tube, as is apparent from FIGS. 2 and 3, a plurality of plate-like shaped fixing members 17 extending in the horizontal direction are mounted on the inner surface of the rear plate 3 and are located on both sides of each opening 6 of the rear plate 3 with respect to the vertical direction. Mask support members 18 having a substantially U-shaped cross-section, for supporting the division masks M1 to M5, and plate support members 11 for supporting the face plate 1 and the rear plate 3 are fixed to the fixing members 17.

Figure 4:
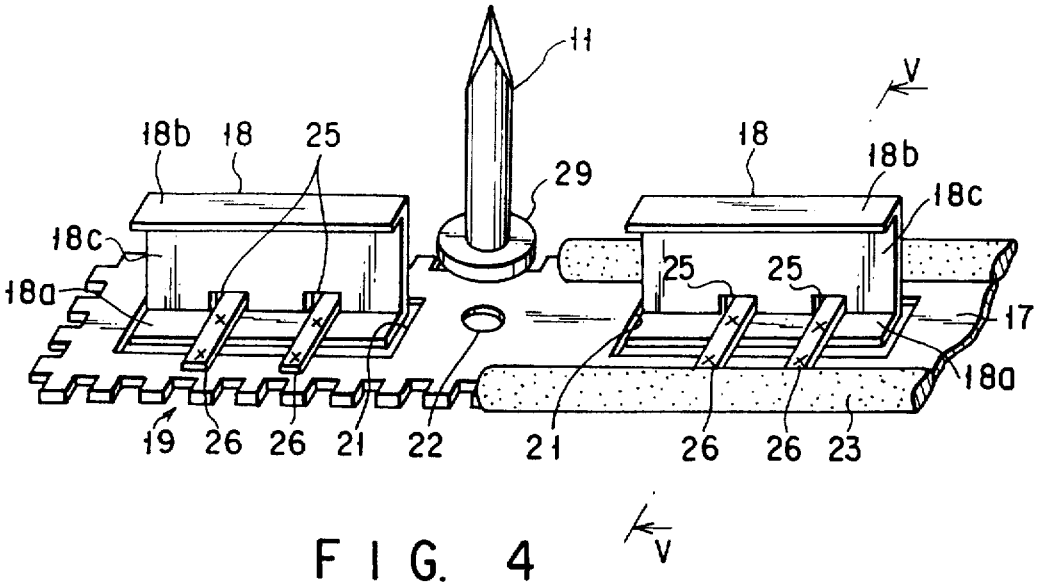

As shown in FIG. 4, each fixing member 17 is made of a metallic plate such as a nickel alloy plate having a coefficient of thermal expansion approximating to that of glass as a material for the rear plate 3, and a recess/projection pattern 19 is formed along the edge of the fixing member 17. In addition, rectangular openings 21 for arranging the mask support members 18 and circular openings 22 for arranging the plate support members 11 are alternately formed in a central flat portion of the fixing member 17 in the horizontal direction. Each rectangular opening 21 has a size slightly larger than the outer size of an end portion of the mask support member 18 so as to allow the end portion to be inserted therein. Each circular opening 22 has a size slightly larger than the outer size of an end portion of the plate support member 11 so as to allow the end portion to be inserted therein. The fixing member 17 is fixed to the inner surface of the rear plate 3 by means of frit glass 23 coated on edge portion of the fixing member 17 in a swelled state (sintering at about 450° C.).

Each mask support member 18 is formed by bending two end portions of a rectangular plate at a right angle. The mask support member 18 has a proximal end portion 18*a* and a support portion 18*b* that extend horizontally, and a vertical portion 18*c* extending therebetween. The vertical portion 18*c* has a pair of through holes 25.

Figure 5:
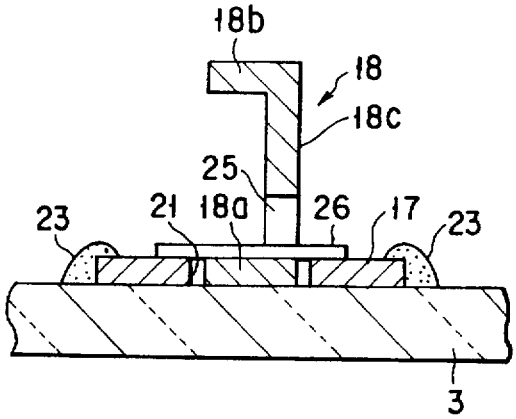

As shown in FIGS. 4 and 5, the proximal end portion 18*a* of the mask support member 18 is inserted in the opening 21 of the fixing member 17 and in close contact with the inner surface of the rear plate 3. In addition, two coupling members, e.g., two leaf springs 26, extend through the through holes 25 formed in the vertical portion 18*c*. Each leaf spring 26 is welded to the fixing member 17 and the proximal end portion 18*a*. With this structure, each mask support member 18 is pressed by the two leaf springs 26 against the rear plate 3 and fixed to the fixing member 17 while the proximal end portion 18*a* is in close contact with the inner surface of the rear plate 3. Note that five mask support members 18 are fixed to each fixing member 17 in correspondence with the five division masks M1 to M5.

As shown in FIG. 2, each of the division masks M1 to M5 is welded to a pair of mask support members 18 which are located adjacent to the vertical end sides of the rear plate 3, while a tensile force is applied to the division mask in the vertical direction, and is supported in a flat manner by other mask support members 18 fixed to an intermediate portion of the rear plate 3 in the vertical direction.

Figure 6:
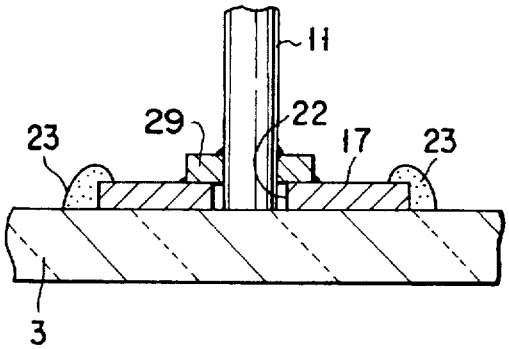

As shown in FIGS. 4 and 6, the proximal end portion of each plate support member 11 is inserted in the opening 22 of the fixing member 17, and a fixing ring 29 is fitted on and welded to the proximal end portion as a coupling member. The fixing ring 29 is also welded to the fixing member 17. Thus, each plate support member 11 is fixed to the fixing member 17 while the proximal end of the plate support member 11 is in close contact with the inner surface of the rear plate 3.

The fixing members 17, the mask support members 18, and the plate support members 11 are mounted by the following process. First, each fixing member 17 is positioned at a predetermined position on the inner surface of the rear plate 3 by using a fixing jig. In order to increase the joining strength with respect to the rear plate 3, frit glass 23 is then coated along the edge of the fixing member 17 in a swelled state and is sintered at about 450° C., thereby fixing the fixing member 17 to the inner surface of the rear plate 3. Thereafter, each mask support member 18 is positioned in the opening 21 by using another fixing jig, and the proximal end portion 18*a* is brought into tight contact with the inner surface of the rear plate 3. In this state, leaf springs 26 are welded to the fixing member 17 and the support member 18. Furthermore, the fixing ring 29 is fitted on the proximal end portion of the plate support member 11, and the proximal end of the support member 11 is positioned in the opening 22 by using still another fixing jig. Subsequently, the plate support member 11 is fixed to the fixing member 17 by welding the fixing ring 29 to the plate support member 11 and the fixing member 17 while the proximal end of the plate support member 11 is in close contact with the inner surface of the rear plate 3.

Figure 8:
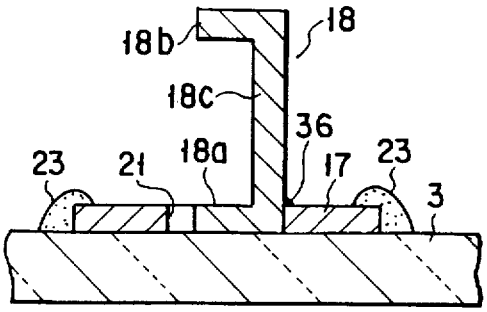
FIG. 8 is a sectional view showing a modification of the mount structure of the mask support member.

In the above embodiment, each mask support member 18 is positioned in a corresponding opening in the fixing member 17 and is brought into tight contact with the inner surface of the rear plate 3 by means of the leaf springs 26. A great importance is attached to the precision of the height (Z direction) of each mask support member 18, but its positional precision (X and Y directions) is not strict relatively. For this reason, as shown in FIG. 8, the proximal end portion 18*a* of the mask support member 18 may be inserted in the opening 21 of the fixing member 17 and moved to one side of the opening 21 so as to be directly welded/fixed to the fixing member 17. In this case, welding is preferably performed while the mask support member 18 is pressed against the rear plate 3 to prevent the proximal end portion 18*a* from separating from the rear plate 3 due to shrinkage of a weld portion 36. In addition, welding is preferably performed at a plurality of portions on both sides of the proximal end portion 18*a* if allowed in terms of structure and precision.

In the manufacture of a color cathode-ray tube, after the fixing members 17, the mask support members 18, and the plate support members 11 are mounted on the rear plate 3 in the above-described manner, the division masks M1 to M5 are respectively mounted on the support portions 18*b* of the mask support portions 18. Thereafter, the rear plate 3 upon which the division masks M1 to M5 are mounted via the fixing members 17 and the mask support members 18, and upon which the plate support members 11 are mounted via the fixing members 17; a plurality of side wall pieces constituting the side wall 2; the face plate 1 having the phosphor screen 8 formed on its inner surface; and the funnels 4 having the electron guns 13 sealed in the necks 12 are situated in a predetermined relationship by using an assembly unit. These components are then integrally joined to one another by means of frit glass. Thereafter, this integrally assembled envelope 5 is evacuated. With this process, a color cathode-ray tube is manufactured.

According to the color cathode-ray tube having the above arrangement, the openings 21 and 22 for mounting the mask support members 18 and the plate support members 11 are formed in the fixing members 17, and the fixing members 17 are fixed to the rear plate 3. The mask support members 18 and the plate support members 11 are fixed to the fixing member 17 while the support members 18 and 11 are in close contact with the inner surface of the rear plate 3 via the openings 21 and 22 of the fixing member 17. With this structure, the shadow mask 9 can be accurately mounted at a predetermined position, and the distance (q-value) between the phosphor screen 8 and the shadow mask 9 can be set with high precision. In addition, the heights of the plurality of plate support members 11 can be set to be equal to one another.

In the conventional structure, the fixing members are fixed to the rear plate. The mask support member and the plate support member are stacked and mounted on the fixing members. In this structure, the fixing members vary in height and tilt because of their thickness, warp, and deformation and because frit glass is placed between the rear plate and the fixing members to secure the fixing members to the rear plate. Consequently, the heights of the mask support members and the plate support members fixed on the fixing member undergo variations exceeding the processing precision of the respective members. In contrast to this, with the arrangement of the present embodiment, the heights of the mask support members 18 and the plate support members 11 are determined only by the processing precision of the respective members 18 and 11. Therefore, the division masks M1 to M5 can be mounted with very high precision, and the q-value can be accurately set. Consequently, there is provided a color cathode-ray tube for reproducing color images free from the problems of color misregistration, overlapping of adjacent regions, and gaps between adjacent regions. In addition, the height of the plate support members 11 can be made equal to one another with sufficient precision so that the load of atmospheric pressure acting on the face plate 1 and the rear plate 3 can be evenly supported by the plurality of plate support members, and an unbalanced state of the plates can be prevented. Therefore, there is provided a color cathode-ray tube which is highly resistant to deformation and vibration and has high reliability with respect to resistance to atmospheric pressure.

Figure 9:
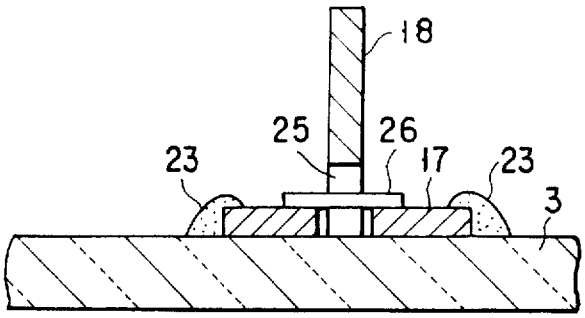
FIG. 9 is a sectional view showing a modification of the mount structure of the mask support member.

In this embodiment, each mask support member has a substantially U-shaped cross-section. However, the shape of the mask support member is not specifically limited as long as it has a proper area which allows tight contact between the inner surface of the rear plate and the mask support member. For example, as shown in FIG. 9, a flat, plate-like mask support member may be used, which is simpler in structure than a mask support member having a U-shaped cross-section in terms of processing precision and mounting operation.

Figure 10A:
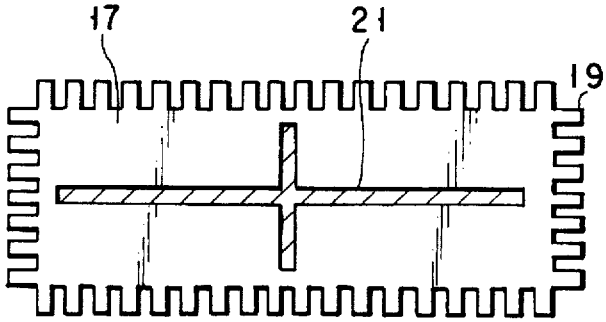
FIGS. 10A to 10C are plan views respectively showing different modifications of the fixing member.
Figure 10B:
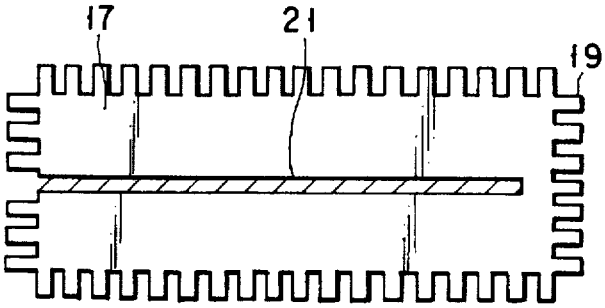
Figure 10C:
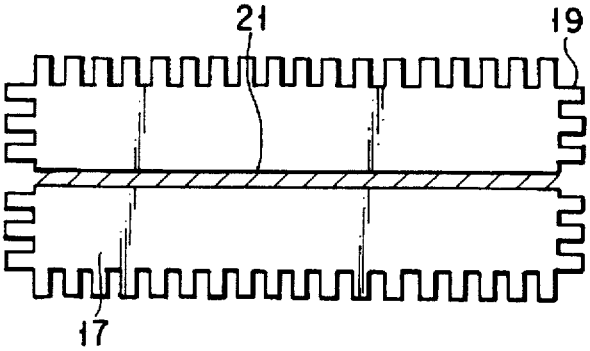

In addition, in this embodiment, a rectangular opening for mounting a mask support member and a circular opening for mounting a plate support member are formed in a fixing member. However, the shapes of these openings are not limited to those in the embodiment as long as the openings for fixing the mask and plate support members are positioned adjacent to regions where the mask and plate support members are arranged in close contact with the inner surface of the rear plate. Notched portions may be formed in place of the openings. Furthermore, a fixing member for fixing only mask support members and a fixing member for fixing only plate support members may be used in place of the above-mentioned fixing member. In this case, the shapes of both the fixing members for the mask support members and the plate support members are not specifically limited. For example, the fixing member for the mask support members may have any one of the three different shapes shown in FIGS. 10A to 10C. A fixing member 17 shown in FIG. 10A has a cross-shaped opening 21. A fixing member 17 shown in FIG. 10B has a linear opening 21. A fixing member 17 shown in FIG. 10C is divided into two parts by a linear opening 21. Referring to FIGS. 10A to 10C, the hatched portions indicate regions (openings 21) in which mask support members are arranged.

The present invention is not limited to the above embodiment but can be applied to a color cathode-ray tube having a different structure including a flat face plate and a flat rear plate. For example, the present invention can be applied to a color cathode-ray tube in which two types of mask support members are used as support members for a flat shadow mask, and the shadow mask is supported by the first mask support members with a tensile force being applied to the shadow mask, while the shadow mask and a phosphor screen are kept at a predetermined distance by the second mask support members. More specifically, while the first and second mask support members are in close contact with the inner surface of a rear plate, the support members are fixed to fixing members which are fixed to the rear plate, thereby providing a color cathode-ray tube having the same effects as those of the embodiment.

The above embodiment has exemplified the color cathode-ray tube having the mask support members fixed to the rear plate side. However, the mask support members may be arranged on the face plate side.

What is claimed is:

1. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope;

mask support means for supporting the shadow mask to face the phosphor screen at a predetermined distance; and plate support means for supporting a load of atmospheric pressure acting on the face plate and the rear plate, the mask support means and the plate support means being fixed to the fixing member and having end portions that contact the inner surface of the rear plate through at least one of an opening and a notch in the fixing member.

2. A cathode-ray tube according to claim 1 which further comprises beam emitting means mounted on the rear plate, for emitting electron beams for dividedly scanning a plurality of regions of the phosphor screen.

3. A cathode-ray tube according to claim 1, wherein said fixing member has an opening, and the end portion of said mask support means contacts the inner surface of the rear plate through the opening.

4. A cathode-ray tube according to claim 3, wherein said opening has an area larger than that of the end portion of the mask support means.

5. A cathode-ray tube according to claim 1, wherein said fixing member has an opening, and the end portion of said plate support means contacts the inner surface of the rear plate through the opening.

6. A cathode-ray tube according to claim 5, wherein said opening has an area larger than that of the end portion of the plate support means.

7. A cathode-ray tube according to claim 1, which further comprises a coupling member for coupling the mask support means to the fixing member.

8. A cathode-ray tube according to claim 7, wherein said coupling member comprises a leaf spring which is fixed to the fixing member and the mask support means.

9. A cathode-ray tube according to claim 7, wherein said coupling member is fixed to the mask support means and the fixing member by welding.

10. A cathode-ray tube according to claim 1, which further comprises a coupling member for coupling the plate support means to the fixing member.

11. A cathode-ray tube according to claim 10, wherein said coupling member comprises a ring-like member which is fixed to the end portion of the plate support means and the fixing member.

12. A cathode-ray tube according to claim 10, wherein said coupling member is fixed to the plate support means and the fixing member by welding.

13. A cathode-ray tube according to claim 1, wherein said mask support means is fixed to the fixing member by welding.

14. A cathode-ray tube according to claim 1, wherein said plate support means is fixed to the fixing member by welding.

15. A cathode-ray tube according to claim 1, wherein said fixing member has a plate-like shape and is fixed to said rear plate with frit glass coated on the fixing member to cover an edge portion thereof.

16. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate, wherein the fixing member has a plurality of openings arranged side by side;

a shadow mask arranged in the envelope;

mask support means for supporting the shadow mask to face the phosphor screen at a predetermined distance; and plate support means for supporting a load of atmospheric pressure acting on the face plate and the rear plate, the mask support means and the plate support means being fixed to the fixing member and having end portions, wherein the end portions of the mask support means and the plate support means contact the inner surface of the rear plate through the openings in the fixing member.

17. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope; and mask support means for supporting the shadow mask to face the phosphor screen at a predetermined distance, the mask support means being fixed to the fixing member and having an end portion that contacts the inner surface of the rear plate through one of an opening and a notch in the fixing member.

18. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope; and plate support means for supporting a load of atmospheric pressure acting on the face plate and the rear plate, the plate support means being fixed to the fixing member and having an end portion that contacts the inner surface of the rear plate through one of an opening and a notch in the fixing member.

19. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope;

a mask support member for supporting the shadow mask to face the phosphor screen at a predetermined distance; and a plate support member for supporting a load of atmospheric pressure acting on the face plate and the rear plate, the mask support member and the plate support member being fixed to the fixing member and having end portions that contact the inner surface of the rear plate through at least one of an opening and a notch in the fixing member.

20. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope; and a mask support member for supporting the shadow mask to face the phosphor screen at a predetermined distance, the mask support member being fixed to the fixing member and having an end portion that contacts the inner surface of the rear plate through one of an opening and a notch in the fixing member.

21. A color cathode-ray tube comprising:

a vacuum envelope having a substantially flat face plate and a substantially flat rear plate opposing the face plate;

a phosphor screen formed on an inner surface of the face plate;

a fixing member fixed to an inner surface of the rear plate;

a shadow mask arranged in the envelope; and a plate support member for supporting a load of atmospheric pressure acting on the face plate and the rear plate, the plate support member being fixed to the fixing member and having an end portion that contacts the inner surface of the rear plate through at least one of an opening and a notch in the fixing member.

* * * * *